US009859044B2

(12) United States Patent
Inagaki et al.

(10) Patent No.: US 9,859,044 B2
(45) Date of Patent: Jan. 2, 2018

(54) POWDER MAGNETIC CORE AND REACTOR USING THE SAME

(71) Applicant: HITACHI CHEMICAL COMPANY, LTD., Tokyo (JP)

(72) Inventors: Takashi Inagaki, Matsudo (JP); Hiroaki Kondo, Matsudo (JP); Chio Ishihara, Katsushika-Ku (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 150 days.

(21) Appl. No.: 14/954,101

(22) Filed: Nov. 30, 2015

(65) Prior Publication Data

US 2016/0293309 A1 Oct. 6, 2016

(30) Foreign Application Priority Data

Mar. 30, 2015 (JP) ..... 2015-069738

(51) Int. Cl.
*H01F 3/08* (2006.01)

(52) U.S. Cl.
CPC ..... *H01F 3/08* (2013.01)

(58) Field of Classification Search
CPC ..... H01F 3/08
USPC ..... 428/402
See application file for complete search history.

(56) References Cited

U.S. PATENT DOCUMENTS

| | | | | |
|---|---|---|---|---|
| 6,054,219 | A | 4/2000 | Satsu et al. | |
| 6,344,273 | B1 | 2/2002 | Satsu et al. | |
| 9,646,756 | B2 * | 5/2017 | Inagaki | B22F 1/02 |
| 2012/0119134 | A1 * | 5/2012 | Muramatsu | B22F 1/02 252/62.55 |
| 2013/0056674 | A1 * | 3/2013 | Inagaki | B22F 1/007 252/62.55 |
| 2016/0240294 | A1 * | 8/2016 | Inagaki | H01F 1/33 |

FOREIGN PATENT DOCUMENTS

| | | | |
|---|---|---|---|
| JP | H09-102409 | A | 4/1997 |
| JP | H09-320830 | A | 12/1997 |
| JP | 2000-235925 | A | 8/2000 |
| JP | 2000235925 | * | 8/2000 |

* cited by examiner

*Primary Examiner* — Leszek Kiliman
(74) *Attorney, Agent, or Firm* — Oliff PLC

(57) ABSTRACT

The powder magnetic core of the present invention can exhibit reliable superposition property in which variance rate of inductance value is small even if superposed current is varied, and can reduce the number of cores used in a reactor. The powder magnetic core comprises: soft magnetic powder particles, and gaps between the soft magnetic powder particles, in which the powder magnetic core has a density ratio of 90 to 95%, and when observing a cross section thereof, layered gaps having thicknesses of 1 to 3 μm and widths of 20 to 200 μm are formed inside of the powder magnetic core. It is desirable that the layered gaps be not less than 50% of all the gaps in a cross sectional area ratio.

8 Claims, 1 Drawing Sheet

POWDER MAGNETIC CORE AND REACTOR USING THE SAME

TECHNICAL FIELD

The present invention relates to a powder magnetic core, and in particular, relates to a powder magnetic core that is appropriate for use as a core of a reactor that is used for controlling and adjusting electric power supply. Furthermore, the present invention relates to a reactor in which the powder magnetic core is used.

BACKGROUND ART

In recent years, so-called low-pollution vehicles such as fuel cell cars, electric cars, hybrid cars and the like have been developed. On the other hand, in contrast to roll out of vehicles with such equipment, there have been large increases in solar power generating capacity, wind power generating capacity, natural refrigerant heat pump water heater capacity and the like. In particular, hybrid cars have increased in Japan and abroad. In such a hybrid car or the like, the voltage of a battery is stepped down to the voltage for electrical components, and direct current is converted to high-frequency alternating current in a case in which a motor or the like is inverter-controlled, via a switching power source or the like.

In a circuit of the above switching power source, a reactor consisting of a core (magnetic core) and a coil wound around the core is arranged. As a property of the reactor, in addition to small size, low loss, and low noise, reliable inductance characteristics with a wide range of direct current is necessary, that is, superior direct current superposition characteristics. Therefore, as a core for reactor, a core in which iron loss is low and magnetic permeability is reliable from low magnetic fields to high magnetic fields, that is, a core having superior constant magnetic permeability, is desirable.

Generally, a core for a reactor is constructed from material such as silicon steel plates, amorphous ribbons, ferrite oxide or the like, and the core constructed from these materials is produced by stacking of flat plate materials, powder compacting forming, powder compacting sintering or the like. Furthermore, in order to improve direct current superposition characteristics, apparent magnetic permeability is controlled by forming an appropriate gap in a magnetic path of the core.

Accompanied by increase in power output of a motor, inverter, or the like, the core of a reactor or the like has been required to be used under large currents and stronger magnetic fields. In such a core for a reactor, it is desirable that inductance not decrease even in higher magnetic fields. However, in the core constructed from the above materials such as silicon steel plates, amorphous ribbons, ferrite oxide or the like, magnetic flux density is saturated at higher magnetic fields since they are highly magnetically permeable materials, and as a result, inductance may be decreased. In order that such a core in which inductance is greatly varied by superposed current may be used in a reactor, design is required so that gaps of the core are increased in thickness, the number of gaps is increased, or the like. However, such design of a core may result in leakage of magnetic flux, increase in loss, increase in noise, and increase in size of the reactor. This is undesirable for use installed in a vehicle or the like in which good fuel economy performance is required and installation space is limited. In addition, since the assembly processes increase, it is disadvantageous from the viewpoint of production cost.

As a core that is different in material organization structure, a powder magnetic core produced by a compression forming a soft magnetic metallic powder such as iron is known. Compared to a laminated magnetic core of silicon steel plates or the like, the powder magnetic core has good material yield during production, and therefore, material cost can be reduced. Furthermore, there is greater freedom of forming, and characteristics can be improved by appropriately designing the shape of the magnetic core. Furthermore, by improving electrical insulating characteristics among metallic powders by mixing electrically insulating material such as organic resin, inorganic powder, or the like into the metallic powder, or by coating the surface of the metallic powder with an electrically insulating coating, eddy-current loss in the magnetic core can be greatly reduced, and superior magnetic characteristics can be obtained, particularly in high frequency ranges. From these characteristics, attention has been drawn to the powder magnetic core as a core for a reactor.

Conventionally, as a raw material for a core for a reactor, material such as silicon steel plates in which 3 to 6.5% of Si is contained in Fe, has been used. However, the silicon steel plate is hard and has poor characteristics for forming into shape. Therefore, from the viewpoints of low cost and superior shaping characteristics, use of powder magnetic cores in which soft magnetic powder having an insulating coating on the surface thereof is compact-formed, has been increasingly common (See patent document 1, for example).

As a method of production of the powder magnetic core, a method is known in which an inorganic insulating coating is formed on a surface of the soft magnetic powder, thermosetting resin powder is mixed into the soft magnetic powder, the powder mixture is compressed and formed, and resin hardening treatment is performed on the resultant powder compact (See patent document 2, for example). Furthermore, since further lower iron loss in powder magnetic cores has been required in recent years, a method is known in which compression forming is performed to obtain a powder compact (powder magnetic core), heat treatment is performed to loosen distortion due to powder compacting forming and hysteresis loss is reduced (See patent document 3, for example).

Patent documents are as follows:

Patent document 1: Japanese Unexamined Patent Application Publication No. Hei 09 (1997)-102409

Patent document 2: Japanese Unexamined Patent Application Publication No. Hei 09 (1997)-320830

Patent document 3: Japanese Unexamined Patent Application Publication No. 2000-235925

In a powder magnetic core, more reliable superposition characteristics can be obtained compared to silicon steel plates or the like; however, it has thus far been impossible to construct a reactor without a magnetic gap, and reactance is adjusted by dividing a core used for the reactor and by filling gap material between the divided core. However, in this case, it is very complicated to assemble the reactor while arranging the gap materials between the divided core and aligning the divisions. Here, if the core used for the reactor has superior superposition characteristics, there may be no need to divide the core, and assembly of the reactor may be facilitated, enabling reduction of the gap material arranged between the divided core, and as a result, magnetic flux leakage can be controlled, loss can be reduced, noise can be reduced, and the size of the reactor can be reduced.

In view of the above circumstances, an object of the present invention is to provide a powder magnetic core in which reliable superposition characteristics are exhibited such that variation in inductance value is small even if superposition current is varied, and in which the number of cores used in the reactor can be reduced.

In order so solve the above subject, as a result of the inventors' research, it was found that by forming layered gaps inside the powder magnetic core, the powder magnetic core can exhibit superior superposition characteristics without dividing the core or arranging gap material, and the present invention was completed.

SUMMARY OF THE INVENTION

In one aspect of the present invention, the powder magnetic core comprises soft magnetic powder particles and gaps between the soft magnetic powder particles, and has a density ratio of 90 to 95%, and the powder magnetic core has layered gaps having interparticle distances of 1 to 3 μm and widths of 20 to 200 μm are formed inside when observing a cross section of the powder magnetic core.

In the above aspect, it is desirable that the layered gaps account for not less than 50% of all gaps in cross sectional area ratio. Furthermore, it is desirable that the powder magnetic core be constructed by insulator-coated iron based soft magnetic powder in which an insulating layer containing powder metallic oxide and calcium phosphate is formed on surface of the iron based soft magnetic powder and the insulating layer is coated with silicone resin.

According to the present invention, a powder magnetic core having superior superposing characteristics can be provided, and a reactor core in which reliability of inductance is improved in high-frequency ranges, together with wide superposed current range, can be provided.

EMBODIMENTS OF THE INVENTION

Figure 1A:
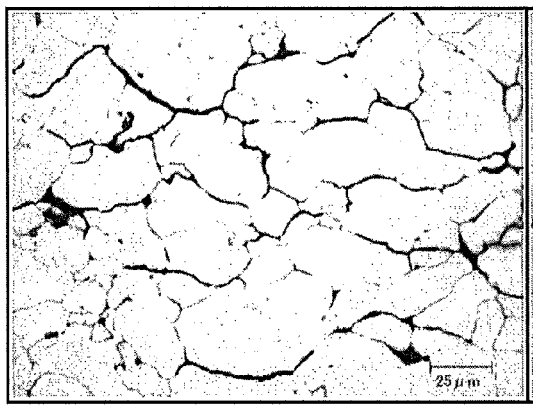
FIG. 1A is a cross sectional micrograph showing one sample of a powder magnetic core of the present invention.

In an ordinary core constructed of a material such as silicon steel plates, amorphous ribbons or ferrite oxide, inductance is greatly decreased even under a small superposed current. Furthermore, under a large current, the inductance value is so close to that of an air core coil that it is meaningless to use the core. Furthermore, if the range of variation in inductance is large, predetermined boosting of voltage is impossible, and a reliable voltage conversion cannot be expected. The powder magnetic core has superior superposition characteristics because magnetic gaps such as resin having low magnetic permeability or pores (gaps between soft magnetic powder particles) are dispersed; however, these characteristics are not sufficient for high currents and strong magnetic fields.

In the present invention, when producing the powder magnetic core using iron based soft magnetic powder having an electrically insulated coating on its surface, by making layered gaps extending along a direction approximately vertical to the direction of magnetic flux in the powder compact body, it becomes possible to improve superposition characteristics of the powder magnetic core because the layered gaps function as magnetic gaps.

If density is decreased, accompanied by decrease of occupying ratio of magnetic body, total inductance may be decreased. In particular, inductance at a large current has a relationship to the density. In a case in which the density ratio is less than 90%, it may be impossible to take advantage of the merits of the high magnetic flux density of the iron based soft magnetic powder. The density is measured by the Archimedes method. In practice, it is measured by the method defined by JIS (Japanese Industrial Standard) Z 2501. Upon forming with such a high density, it is desirable to use soft magnetic powder having average particle diameters (median diameters) of about 50 to 150 μm, as the insulator-coated iron based soft magnetic powder.

On the other hand, in a case in which the density ratio is greater than 95%, the amount of gaps inside the powder magnetic core may be decreased, and a non-magnetic part that acts as a magnetic gap when used as a core may be extremely reduced. In this case, although inductance value is increased under large current, magnetic permeability may be increased with increasing density. As a result, initial inductance may be greatly increased and the range of variation of inductance by the presence or absence of superposed current may be increased.

Commonly observed gaps between soft magnetic powder particles in a powder magnetic core, that is pores, are locally arranged like a dot when observed in a cross section of the powder compact body. In this case, they act as like small magnetic gaps, and since flow of magnetic flux is generated between tightly close particles, it may be difficult to reduce saturation of magnetic flux density. On the other hand, even if it has the same density, that is, the same amount of gaps (pores), in a case in which layered gaps are formed along approximately a vertical direction of the direction of magnetic flux, air layers may exist between the soft magnetic powder particles, each layered gap may function as magnetic gap, and the magnetic saturation can be delayed.

Figure 1B:
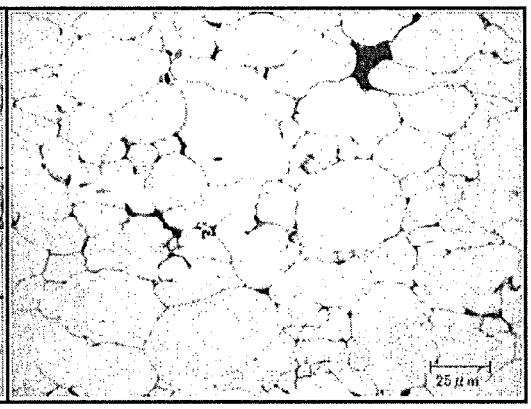
FIG. 1B is that of a conventional one.

FIGS. 1A and 1B show differences between pore distribution of the powder magnetic core having the layered gaps of the present invention and that of a conventional powder magnetic core. FIG. 1A is one example of a powder magnetic core having layered gaps of the present invention and FIG. 1B is that of a conventional one. Both are photographs of a mirror-polished cross section of a powder magnetic body and taken through a microscope. As shown in FIG. 1B, the conventional powder magnetic core has fewer pores, and only relatively small pores are dispersed. On the other hand, in the powder magnetic core of the present invention shown in FIG. 1A, the layered gaps (pores) that are laterally long and having thickness to some extent are distributed along an interface of the soft magnetic powder. In the powder magnetic core of the present invention, since such a layered gap functions as a magnetic gap, superior superposition characteristics can be exhibited, in which magnetic saturation is delayed and variance of inductance value versus variance of superposed current is controlled.

However, in a case in which thickness of the layered gap between adjacent particles is small when observing a cross section of a powder magnetic body, it may be difficult to delay magnetic saturation. Therefore, it is desirable that the thickness of the layered gap be not less than 1 μm. On the other hand, in a case in which thickness of the layered gap is greater than 3 μm, the gap may be almost the same shape as pores even if the total amount of gaps is the same, and it may no longer function as a magnetic gap.

In a case in which a width of the layered gap (longitudinal direction of the gap) when observed in a cross section of the powder magnetic core is less than 20 μm, since the width is shorter than the diameter of a metallic particle, particles are too close to each other, and it may not function as a magnetic gap. Furthermore, in a case in which width of the layered gap is greater than 200 μm, soft magnetic powders poorly interact with each other, and strength of the powder magnetic core may be extremely deteriorated. A reactor is not a driving part of a motor or the like; however, it must have strength sufficient to withstand handling during assembly of the powder magnetic body used as a core, or when exposed to vibrations from a car body if it is installed in a car. Furthermore, since vibrations are generated by magnetostriction when it is driven as a reactor, it desirably has high strength. Therefore, it is desirable that the width of the layered gap be not greater than 200 μm in order to maintain the same strength as a powder magnetic core having ordinary pore shape.

It is desirable that the above-mentioned layered gap be formed across the direction of magnetic flux because function as a magnetic gap cannot be obtained if it is formed along the direction of magnetic flux, and it is more desirable that as large a number of the layered gaps as possible be formed approximately vertical to the direction of magnetic flux.

As the iron based soft magnetic powder, powder of pure iron or iron based metal including Fe—Si alloy, Fe—Al alloy, permalloy and sendust are used, and pure iron powder is superior from the viewpoint of high magnetic flux density, forming property and the like.

The electronically insulating coating which is formed on the surface of the soft magnetic powder can be one which can maintain insulating characteristics at temperature of heat treatment, and an electronically insulating coating containing phosphate salt is desirable from the viewpoint of strength of the powder compact body, since particles may be bound to each other when heat-treated. The soft magnetic powder that is coated by an inorganic insulating coating can be appropriately selected from commercially available products, and alternatively, a coating of an inorganic compound can be formed on the surface of the soft magnetic powder according to a conventionally known method so as to use it. For example, according to the disclosure of the above patent document 2, an aqueous solution containing phosphoric acid, boric acid, and magnesium is mixed with iron powder and then dried, so as to obtain insulator-coating soft magnetic powder in which about 0.7 to 11 g of inorganic insulating coating is formed on 1 kg of iron powder.

Furthermore, as the powder magnetic core, a powder magnetic core can be employed in which resin component is contained and soft magnetic powder is bound by the resin component. In this case, if the amount of resin component is too great, the amount of soft magnetic powder decreases, and as a result, occupying rate is decreased and magnetic flux density is decreased. Therefore, it is desirable that addition of the resin component be not more than 0.5 mass %.

In a case in which decreasing rate of inductance of the powder magnetic core is greater than 30% under conditions in which superposed current is varied from 0 A to 20 A at 20 kHz and 1 V, variation in rate before and after superposition may be large, and it may become necessary to adjust inductance by a gap material or the like. Therefore, it is desirable that the rate of variation of inductance be not more than 30%.

The powder magnetic core is produced as follows: soft magnetic powder, which is a raw material powder, is filled in a space (die cavity) formed between a mold hole of a die and a lower punch; the raw material powder is compressed and formed by an upper punch and the lower punch; a compact powder body which is compressed and formed is expelled from the mold hole of the die; and it is heat-treated if necessary. The above-mentioned powder magnetic core having layered gaps can be produced, for example, by changing the moving speed of the upper and lower punches during compression and formation, and distance of the gap between the upper and lower punches and the mold hole of the die. That is, in a case in which moving speeds of the upper and lower punches are slow, air present among the raw material powder particles filled in the die cavity can exit through the gap between the upper and lower punches and the mold hole of the die. On the other hand, in a case in which moving speeds of the upper and lower punches during compression and formation are faster than a certain value, air present among the raw material powder particles filled in the die cavity cannot exit, and the air is also compressed, and a part where such air was present may be formed as the layered gap.

Furthermore, as another example, in a case in which the powder magnetic core is produced by heat treatment, a material such as paraffin, which can be vaporized or decomposed by a latter heat treatment, can be added in the form of flakes to the raw material powder. In this case, the flakes, which can be vaporized or decomposed by a latter heat treatment, are dispersed in the powder compact body after compression and formation, and the flake material may be made to disappear by being vaporized or decomposed during the heat treatment, so that the parts where the flake material was present may be formed as the layered gap.

EXAMPLES

As the iron based soft magnetic powder having an insulating coating, MH20D powder produced by Kobe Steel Ltd., was prepared. Using a mold having dimensions of 30 mm longitudinally and 60 mm laterally as a side core shape, a mold lubricating method was employed in which a drying coating lubricating material was coated on a wall surface of the dies and was dried, and the iron based soft magnetic powder was used. Thickness of the side core was set at 20 mm, and formation was performed by varying formation stroke at a density of 7.3 $Mg/m^3$. In addition, using a mold having a diameter of 20 mm as a middle core shape, the mold lubricating method was employed in which the drying coating lubricating material was coated on a wall surface of the dies and was dried. Thickness of the middle core was set at 30 mm, and formation was performed by varying formation stroke at a density of 7.3 $Mg/m^3$, the same as the side core. The formed body produced was processed by heat treatment at 500° C. in a nitrogen atmosphere in a mesh belt furnace.

After the heat treatment, two pieces of the side cores and four pieces of the middle cores were prepared. Each core was faced at a punch surface and unified without using a gap material or the like. After that, excitation winding was performed for 35 turns so as to obtain a reactor core, and its superposition characteristics were evaluated by a direct current superposition testing apparatus LMB-2101B produced by Kokuyo Electric Co., Ltd. Frequency during the evaluation was 20 kHz, and inductance from 0 A to 20 A was measured.

Furthermore, with respect to amount of layered gap in the cross section of the powder compact body, each surface was photographed by an optical microscope at 200 times magnification, thickness and width of each gap (pore) was measured in the resulting image, and area ratio was measured by image analyzing software WinRoof produced by Mitani Sangyo Co., Ltd.

Table 1 shows the average value of thickness of the gaps and the average value of the width of the gaps, which were measured, inductance value at 0 A $L_{0A}$, inductance value at 20 A $L_{20A}$, and decreasing rate between these inductances. In addition, FIG. 2 shows variation of inductance value in each sample when superposed current varied from 0 A to 20 A.

TABLE 1

| | Layered gap | | | | Inductance value | | |
|---|---|---|---|---|---|---|---|
| Sample No. | Thickness μm | Width μm | Ratio versus total gaps % | Density ratio % | $L_{0A}$ | $L_{20A}$ | Decreasing rate % |
| 01 | 0.5 | 10 | 42 | 92.8 | 3520 | 1519 | 56.8 |
| 02 | 1 | 20 | 54 | 92.8 | 2850 | 2007 | 29.6 |
| 03 | 2 | 100 | 61 | 92.8 | 2453 | 1742 | 29.0 |
| 04 | 3 | 200 | 68 | 92.8 | 2042 | 1580 | 22.6 |
| 05 | 5 | 300 | 73 | 92.8 | 1770 | 1437 | 18.8 |

Figure 2:
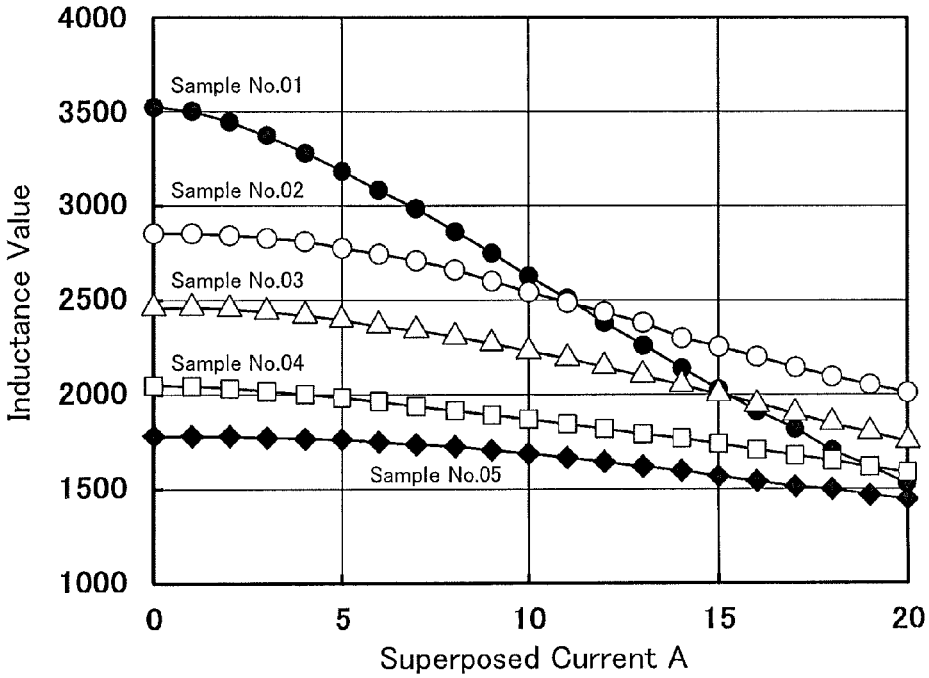
FIG. 2 is a graph showing variance of inductance value by superposed current of each sample in the Example.

As shown in Table 1 and FIG. 2, the sample No. 01 which had average thickness of layered gaps of less than 1 μm and average width of less than 20 μm had high $L_{0A}$ and low $L_{20A}$, and thus, rate of decrease of inductance value was large. On the other hand, the sample No. 02, which had average thickness of layered gaps of 1 μm and average width of 20 μm, had high $L_{20A}$ in spite of decreased $L_{0A}$, and thus, rate of decrease of inductance value was small. Furthermore, as the average thickness and average width of layered gaps increased, $L_{0A}$ and $L_{20A}$ further decreased, and there was a tendency for the rate of decrease of inductance value to become smaller. However, the sample No. 05, which had an average thickness of layered gaps of more than 3 μm and average width of more than 200 μm had low $L_{0A}$ value and $L_{20A}$ value of less than 1500, in spite of small rate of decrease of inductance value.

From the above results, it was confirmed that by dispersing layered gaps having average thicknesses of 1 to 3 μm and average widths of 20 to 200 μm into the powder magnetic core, the layered gap acts as a magnetic gap, decreasing rate of inductance becomes smaller, and reliable superposition characteristics are exhibited.

The present invention can be appropriately used for electric transformers, reactors, choke coils, and in particular, iron cores for magnetic circuits in which size reduction is required, such as reactors for installation in cars, and can provide powder magnetic cores having superior direct current superposition characteristics. In particular, the present invention is desirable for use in a frequency range of several kHz to 100 kHz.

What is claimed is:

1. A powder magnetic core comprising:

soft magnetic powder particles, and layered gaps between the soft magnetic powder particles, wherein the layered gaps were formed by pores generated in compacting the soft magnetic powder particles, and the powder magnetic core has a density ratio of 90 to 95%, and when observing a cross section thereof, the layered gaps having thicknesses of 1 to 3 μm and widths of 20 to 200 μm.

2. The powder magnetic core according to claim 1, wherein the layered gaps are not less than 50% of all the gaps in a cross sectional area ratio.

3. The powder magnetic core according to claim 1, wherein the powder magnetic core is constructed by insulator-coated iron based soft magnetic powder in which an insulating layer containing powder metallic oxide and calcium phosphate is formed on the iron based soft magnetic powder and the insulating layer is coated by silicone resin.

4. The powder magnetic core according to claim 1, wherein decreasing rate of inductance is not more than 30% when superposing from 0 A to 20 A under 20 kHz and 1 V.

5. A reactor comprising the powder magnetic core according to claim 1.

6. A reactor comprising the powder magnetic core according to claim 2.

7. A reactor comprising the powder magnetic core according to claim 3.

8. A reactor comprising the powder magnetic core according to claim 4.

* * * * *